US010611599B1

(12) United States Patent
Staley et al.

(10) Patent No.: US 10,611,599 B1
(45) **Date of Patent: *Apr. 7, 2020**

(54) DEVICE FOR ROLLING UP AND UNROLLING A FLOATING MAT

(71) Applicants: Thomas G. Staley, Charter Oak, IA (US); Paul J. Assman, Denison, IA (US)

(72) Inventors: Thomas G. Staley, Charter Oak, IA (US); Paul J. Assman, Denison, IA (US)

( * ) Notice: Subject to any disclaimer, the term of this patent is extended or adjusted under 35 U.S.C. 154(b) by 8 days.

This patent is subject to a terminal disclaimer.

(21) Appl. No.: 16/156,108

(22) Filed: Oct. 10, 2018

(51) Int. Cl.
*B65H 75/44* (2006.01)
*B63B 34/00* (2020.01)

(52) U.S. Cl.
CPC ..... *B65H 75/4492* (2013.01); *B63B 34/00* (2020.02)

(58) Field of Classification Search
CPC ..... B65H 75/44; B65H 75/4481; B65H 75/4492; B63B 35/73
See application file for complete search history.

(56) References Cited

U.S. PATENT DOCUMENTS 5,810,281 A * 9/1998 Kole ..... B65H 75/22 242/532.6
6,386,476 B1 * 5/2002 Adleman, Jr. ..... E04G 23/006 156/763
2004/0108404 A1 * 6/2004 Wiermaa ..... B65H 18/10 242/532.6
2018/0162671 A1 6/2018 Kuss
2018/0251334 A1 * 9/2018 Behrendt ..... B65H 75/22

* cited by examiner

*Primary Examiner* — Sang K Kim
(74) *Attorney, Agent, or Firm* — Dennis L. Thomte; Thomte Patent Law Office LLC

(57) ABSTRACT

A device for rolling up and unrolling a floating mat with the floating mat having a first end, a second end, a first side, a second side, an upper surface and a bottom surface is disclosed. The device of the invention includes an elongated hollow cylinder having a first end, a second end and an outer surface. The cylinder has an elongated slot formed in the outer surface thereof which extends between the ends thereof. A mat retainer bar is positioned in the cylinder. One end of the mat extends inwardly through the slot in the cylinder and is secured to the mat retainer bar. End caps are secured to the ends of the cylinder and have a lever secured thereto. The mat may be rolled up on the cylinder or unrolled from the cylinder by rotating the cylinder by way of the levers.

14 Claims, 6 Drawing Sheets

DEVICE FOR ROLLING UP AND UNROLLING A FLOATING MAT

BACKGROUND OF THE INVENTION

Field of the Invention

This invention relates to a device for rolling up and unrolling a floating mat. More particularly, this invention relates to a device for rolling up, storing, carrying and unrolling a floating mat.

Description of the Related Art

Floating mats have become very popular in recent years. The floating mats are generally manufactured from a foam product and have lengths ranging from 15 to 18 feet, widths from 5 to 6 feet and have thicknesses from 1⅜$^{th}$ inches to 2 inches. The floating mats are used for water recreation. Most often they are carried on boats to various locations on lakes where the boats are anchored and the mats are unrolled onto the surface of the water to be enjoyed by swimmers. In some cases, the mats are simply unrolled from the end of a dock where they are enjoyed as well. The challenge of the floating mats is that when it is time to wrap up a day of leisure on the lake they have to be rolled up and stored on the boat. This can be somewhat of a challenge.

The prior art is replete with different types for rolling up the floating mats for storage or transport. Some of the prior art products are manufactured from metal although boat owners do not like to use metal products on their expensive boats due to the potential for damage to the upholstery and the fiberglass or aluminum of the boat. Some of the prior art devices for rolling up the floating mats require that they be assembled and disassembled each time they are used. Further, the prior art devices for rolling up the floating mats may be difficult to not only roll up the floating mats but also to pick up and carry the rolled up mat.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A device is described for rolling up and unrolling a floating mat, having a first end, a second end, a first side, a second side, a top surface and a bottom surface. The device of the invention includes an elongated hollow cylinder having a first end, a second end, and an outer surface. Preferably, the hollow cylinder is comprised of a plastic material. The cylinder includes an elongated slot, having first and second ends, which is formed in the outer surface thereof which extends between the first and second ends of the cylinder. An elongated mat retainer is provided having a first end, a second end, a first side and a second side. The mat retainer has an elongated slot formed therein which extends inwardly thereinto from one side thereof. The slot of the mat retainer is configured to receive the first end of the floating mat therein. The first end of the floating mat is secured to the mat retainer by a plurality of bolts or the like.

The mat retainer and the first end of the floating mat are positioned in the cylinder by slidably extending the mat retainer and the first end of the floating mat attached thereto into one end of the cylinder with the floating mat extending outwardly through the slot in the cylinder. A first end cap is selectively secured to the first end of the cylinder and a second end cap is selectively secured to the second end of the cylinder. An elongated first lever, having first and second ends, extends outwardly from the first end cap with the first lever being transversely disposed with respect to the first end cap and the cylinder. An elongated second lever, having first and second ends, extends outwardly from the second end cap with the second lever being transversely disposed with respect to the second end cap and the cylinder.

In the preferred embodiment, the first and second end caps are threadably secured to the first and second ends of the cylinder respectively. In one embodiment, each of the first and second end caps is cylindrical with open ends. In a second embodiment, which is the preferred embodiment, the outer ends of the end caps are shaped to provide a handle to enable a person to grasp the same to carry the rolled-up mat. In the preferred embodiment, each of the first and second levers are slidably secured to the first and second end caps respectively. In the preferred embodiment, at least one of the first and second levers has an enlarged cap nut threadably secured to one end thereof so that the cap nut may be removed therefrom to enable the lever to be removed from the respective end cap.

It is therefore a principal object of the invention to provide an improved device for rolling up and unrolling a floating mat.

A further object of the invention is to provide a device of the type described which includes an elongated hollow cylinder which is comprised of a plastic material with one end of the floating mat extending through a slot in the side of the container and maintained therein by a mat retainer.

A further object of the invention is to provide a device of the type described which has the ends of the hollow cylinder closed by end caps with levers being slidably secured to the end caps.

It is a further object of the invention to provide a device of the type described which is easy to use and which enables a floating mat to be easily rolled up around an elongated hollow cylinder and easily carried.

A further object of the invention is to provide a device of the type described which does not require disassembly and assembly between uses.

A further object of the invention is to provide a device of the type described which is economical of manufacture, durable in use and refined in appearance.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
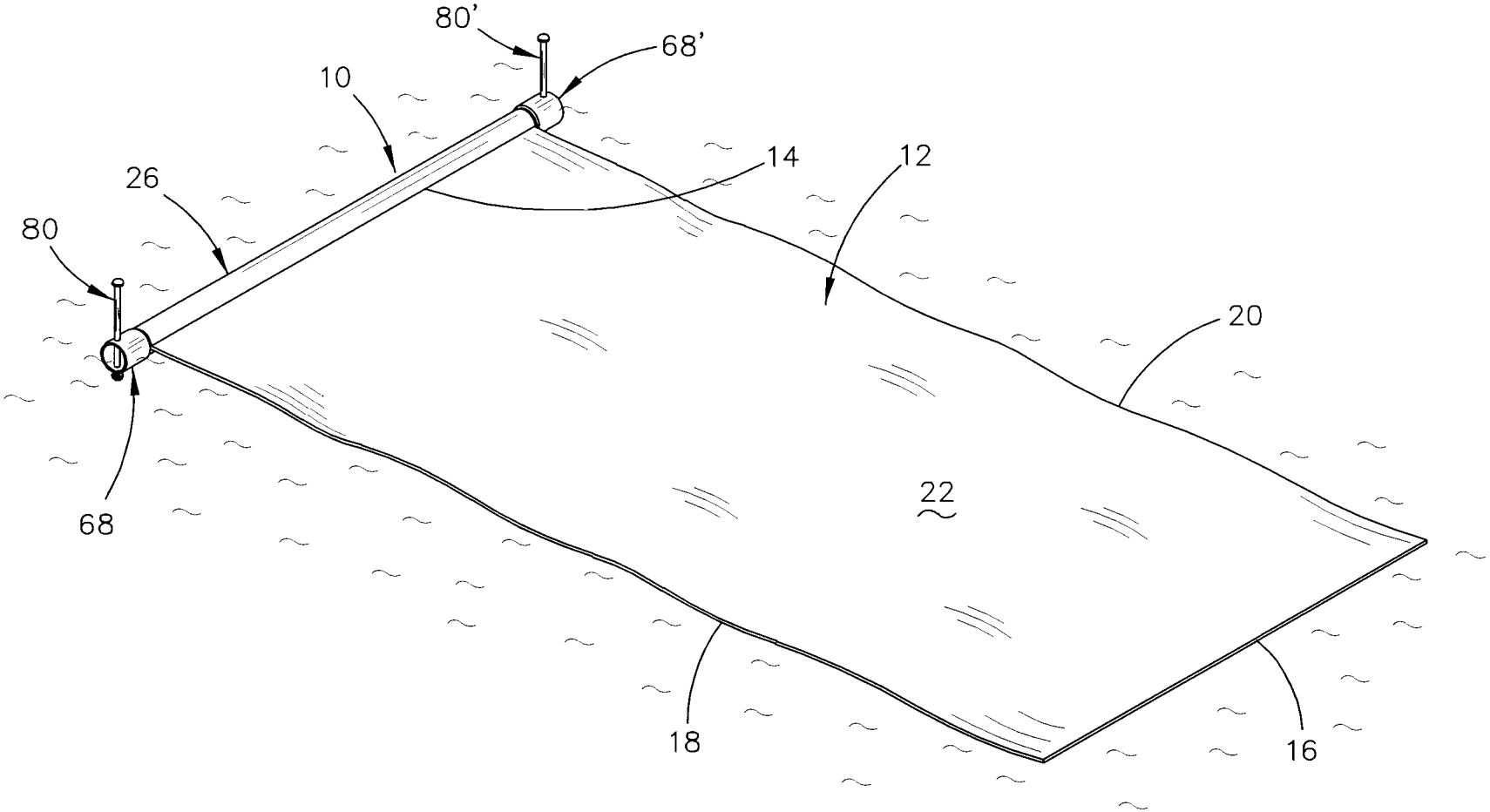
FIG. 1 is a perspective view illustrating the device of this invention secured to one end of a floating mat.
Figure 2:
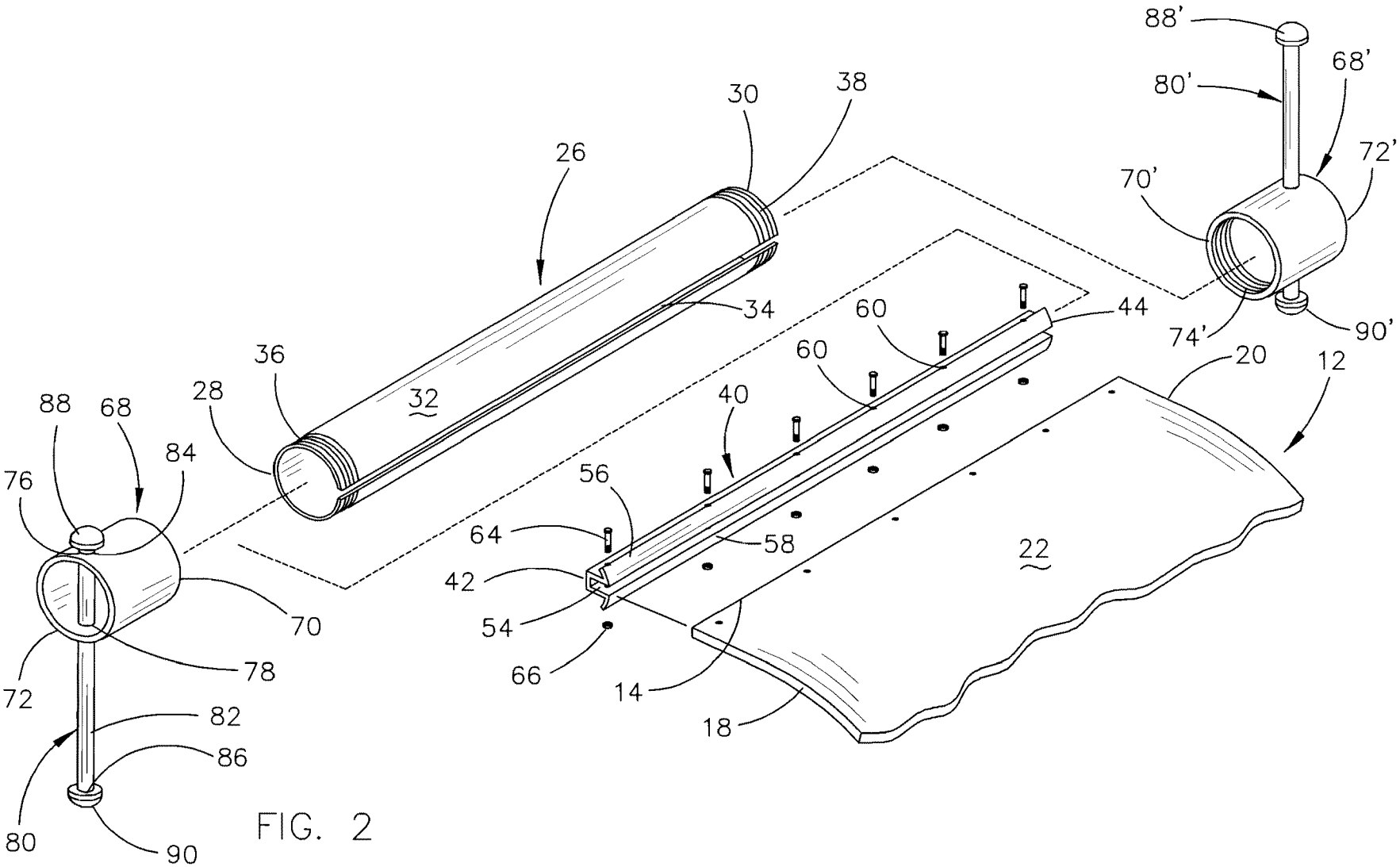
FIG. 2 is a partial exploded perspective view of the device of this invention and its relationship to one end of a floating mat.
Figure 3:
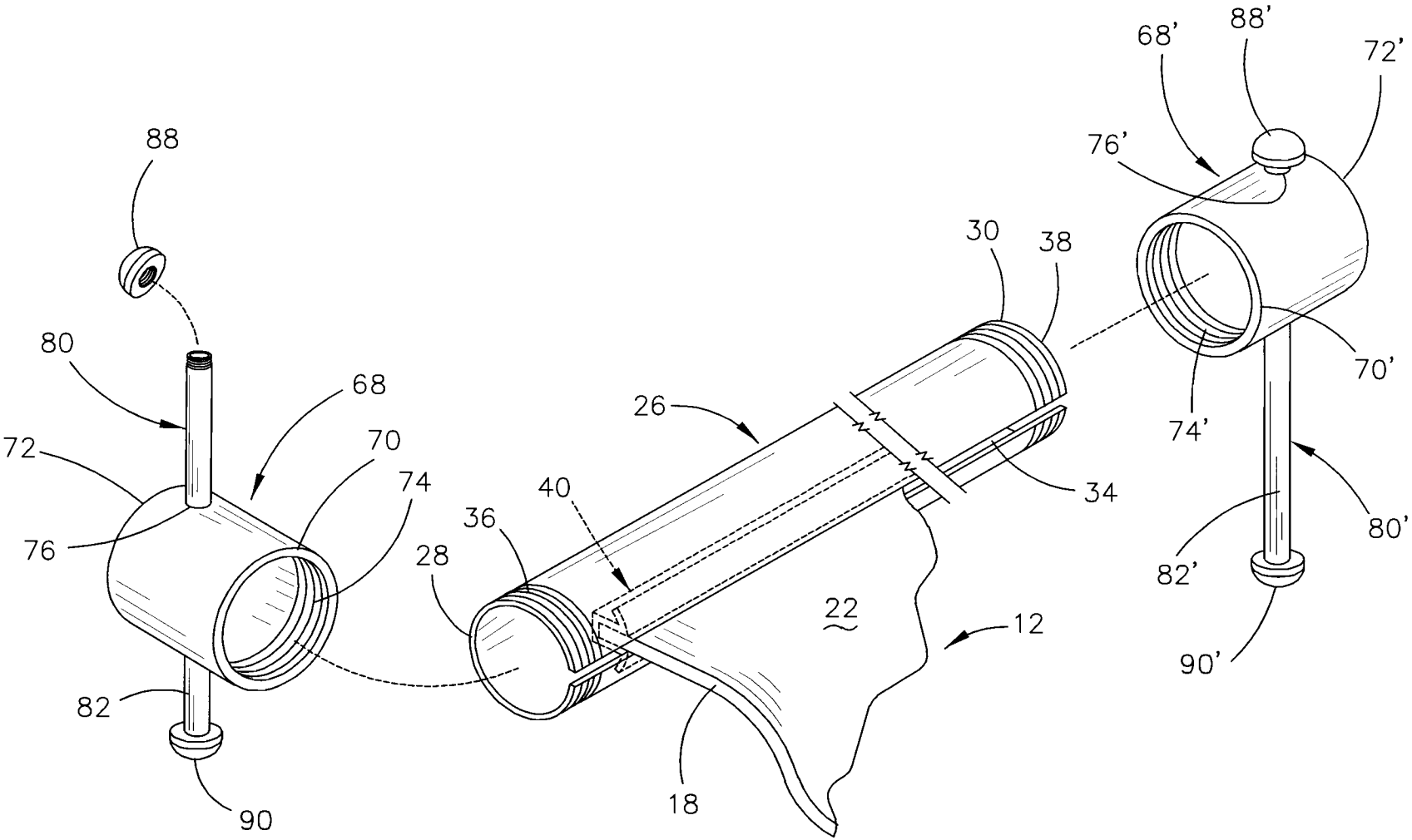
FIG. 3 is a further partial perspective view of the device of this invention and its relationship to one end of a floating mat.
Figure 4:
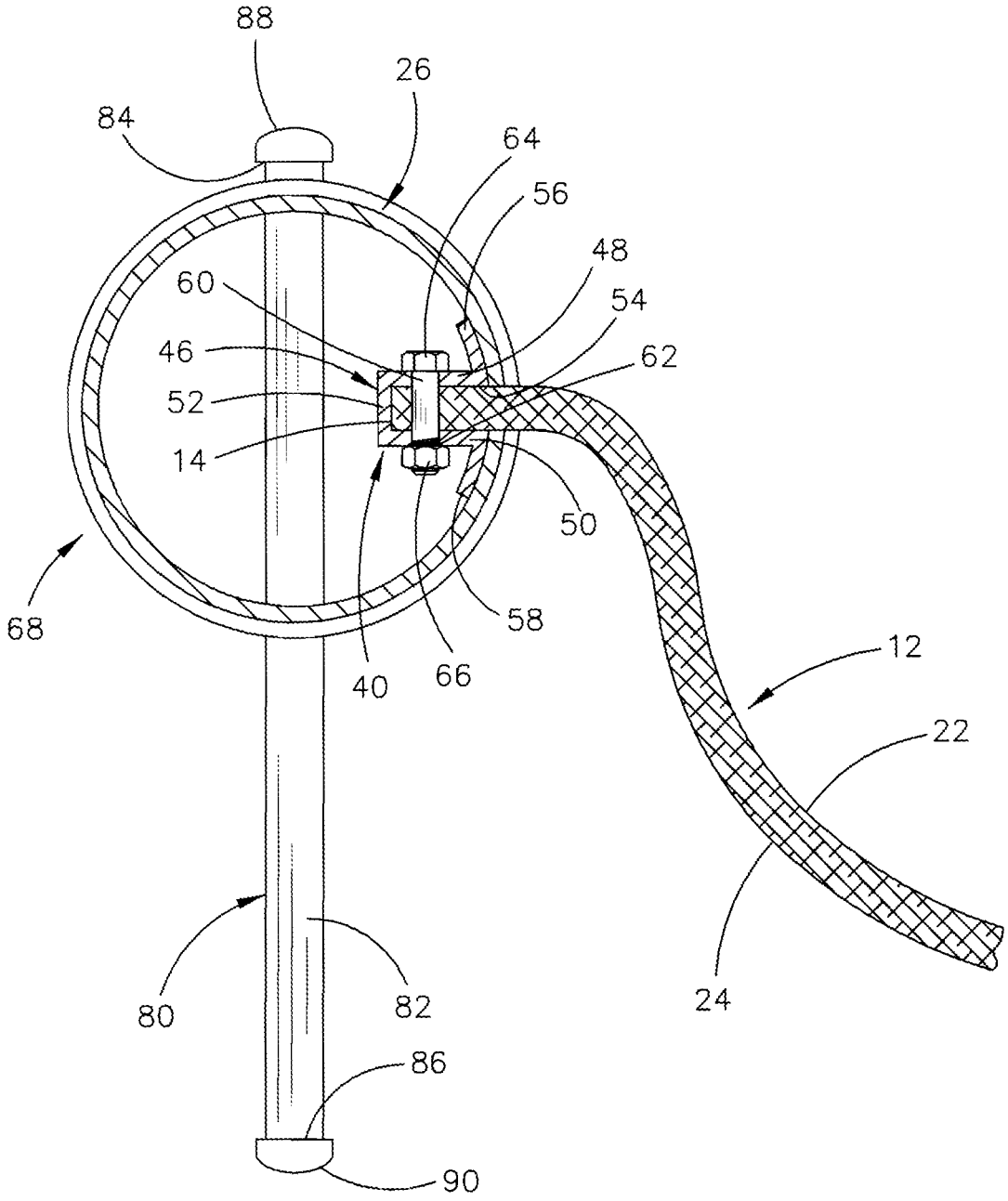
FIG. 4 is a partial sectional view of the device of this invention having one end of a floating mat secured thereto.
Figure 5:
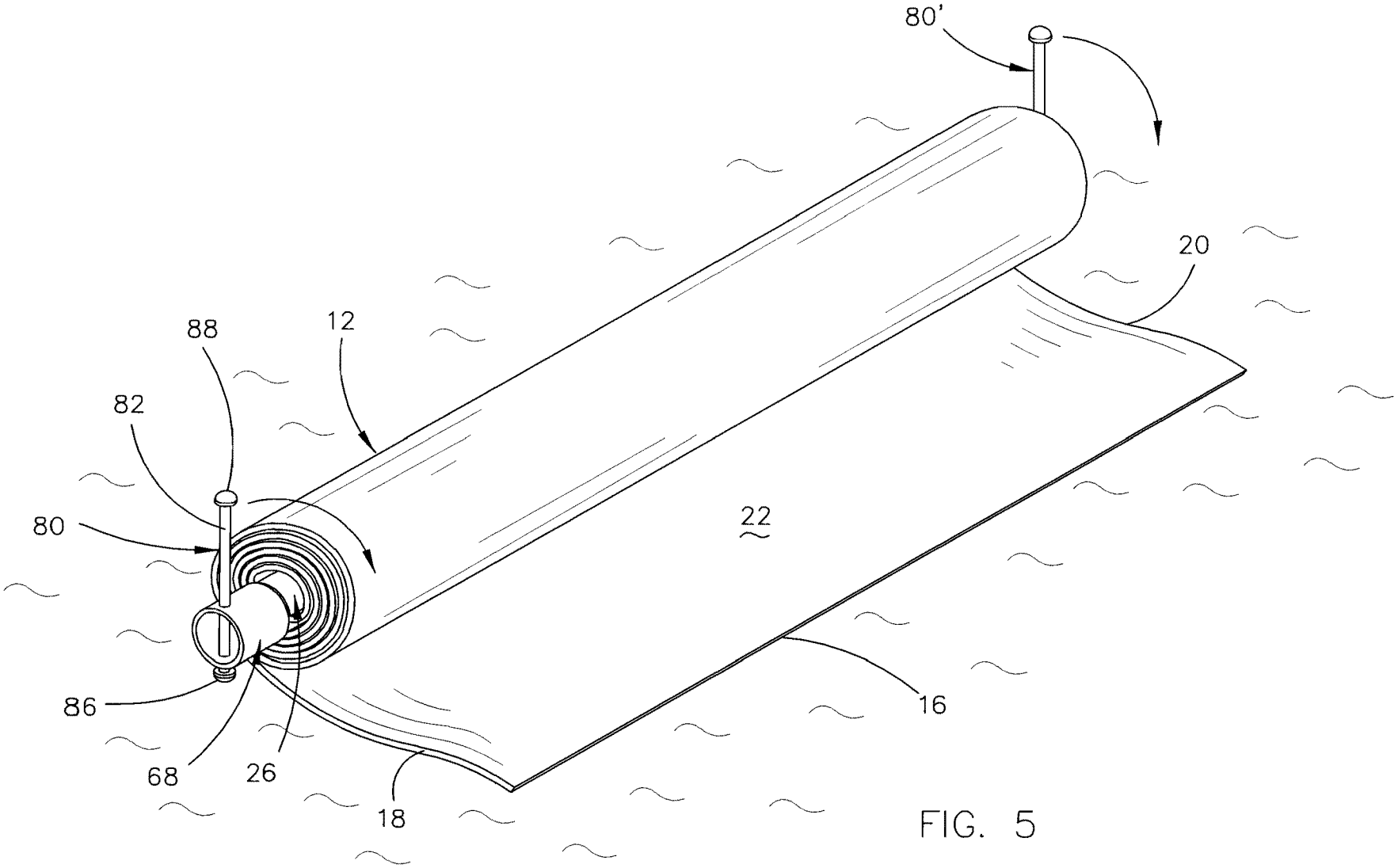
FIG. 5 is a perspective view illustrating a floating mat being roiled-up onto the device of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The device for rolling-up, storing, unrolling and securing a floating mat is designated by the reference numeral 10. The numeral 12 refers to a conventional floating mat which is comprised of a foam product such as polyethylene or the like and which may have a length ranging from 15 to 18 feet, widths from 5 to 6 feet, a thickness of 1⅜ths inches to 2 inches. For purposes of description, mat 12 will be described as having a first end 14, a second end 16, a first side 18, a second side 20, an upper side 22 and a lower side 24.

Device 10 includes an elongated hollow cylinder 26 which is comprised of a plastic material such as PVC. Cylinder 26 has a first end 28, a second end 30, and a cylindrical wall 32. Wall 32 has an elongated slot 34 formed therein which extends between ends 28 and 30. Preferably, the exterior surface of cylinder 26 has a tapered threaded portion 36 formed therein at end 28 of cylinder 26. Preferably, the exterior surface of cylinder 26 has a tapered threaded portion 38 formed therein at end 30 of cylinder 26.

The numeral 40 refers to an elongated mat retainer bar having a first end 42 and a second end 44. The retainer bar 40 has the same length as the width of the floating mat involved. Retainer bar 40 is preferably comprised of a plastic material. Retainer bar 40 has a horizontally disposed and generally U-shaped body portion 46 which includes an upper wall 48, a lower wall 50, and a side wall 52 which defines a channel 54, and curved wings 56 and 58 which extend from upper wall 48 and lower wall 50 respectively. Upper wall 48 has a plurality of spaced-apart bolt holes 60 formed therein. Lower wall 50 has a plurality of spaced-apart bolt holes 62 formed therein which register with the bolt holes 60.

As seen, the inner end 14 of mat 12 is received in the channel 54 of the mat retainer bar 40. The inner end 14 of mat 12 is maintained in the channel 54 by a plurality of bolts 64, which are preferably plastic, which extend through the holes 60, through holes in mat 12 and outwardly through holes 62 of retainer bar 40. Nuts 66 are threadably secured to the lower ends of the bolts 64.

Figure 6:
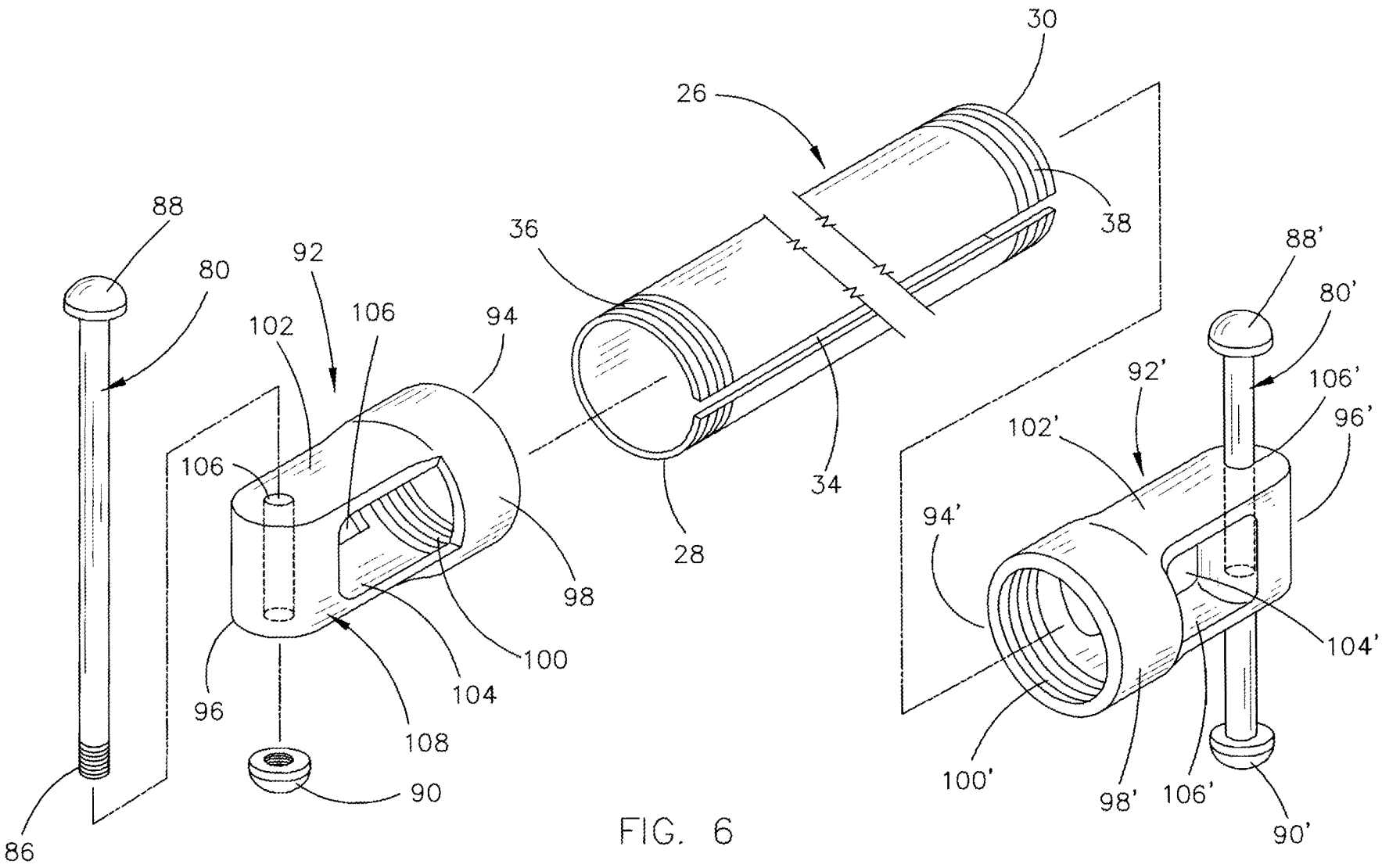
FIG. 6 is an exploded partial perspective view of a modified form of the end caps of this invention.

The numeral 68 refers to a hollow plastic end cap which is cylindrical in shape and which includes an inner end 70 and an outer end 72. FIGS. 1-5 illustrate one embodiment of the end cap 68. The preferred embodiment of the end cap is shown in FIG. 6 and will be described in detail hereinafter. The end cap 68 has an internal threaded portion 74 at its inner end 70. End cap 68 is selectively threadably secured to the threaded portion 36 of cylinder 26. End cap 68 has an upper opening 76 formed therein inwardly of end 72 thereof. End cap 68 also has a lower opening 78 formed therein inwardly of end 72 thereof which is aligned with opening 76.

The numeral 80 refers to a first lever 80 which includes an elongated shaft 82 having a first end 84 and a second end 86. A threaded cap nut 88 is threadably secured to end 84 of shaft 82. A threaded cap nut 90 is secured to end 86 of shaft 82. As seen, shaft 82 movably extends through openings 76 and 78 in end cap 68. An end cap 68' is threadably secured to the threaded portion 38 of cylinder 26. Inasmuch as end cap 68' is identical to end cap 68, only end cap 68' and the associated lever will not be described in detail with "'" indicating identical structure on end cap 68'.

In summary, the inner end of the mat 12 is secured to the mat retainer 40 by the bolts 64. The inner end of the mat 12 at the retainer bar 40 are inserted into the cylinder 26 as described above. The end caps 68 and 68' are then threadably secured to cylinder 26. The levers 80 and 80' are then grasped by the persons who are going to roll-up the mat 12 onto the cylinder 26. The levers 80 and 80' are then rotated which causes the mat 12 to be rolled onto the cylinder 28. Once the mat 12 is rolled-up, a rope or string will be extended around the rolled-up mat to maintain the mat 12 in the rolled-up position. The rolled-up mat 12 may then be carried from location to another by a person or persons by grasping the end caps 68 and 68' or the levers 80 and 80'. When it is desired to unroll the mat, the outer end of the mat 12 is grasped and pulled outwardly from the cylinder 26.

FIG. 6 is an exploded partial perspective view of the modified end caps of this invention which represent the preferred embodiment of the end caps. The numeral 92 refers to the end cap of the preferred embodiment. End cap 92 includes an inner end 94 and an outer end 96. End cap 92 includes a cylindrical portion 98 at its inner end which has internal threads 100. End cap 92 includes a tapered outer end portion 102 which extends outwardly from the outer end of cylindrical portion 98 and which has open sides 104 and 106. End portion 102 has a vertically disposed opening 106 formed therein which is configured to receive the lever 80 therein. The threads 100 are threadably secured to the threads 36 of cylinder 26. When so installed, the tapered outer end portion 102 and the open sides 104 and 106 form a handle 108 to enable a person to grasp the same to carry or position the device.

The numeral 92' refers to the end cap at the outer end of the cylinder 26. Inasmuch as end cap 92' is identical to end cap 92, end cap 92' will not be described in detail with "'" indicating identical structure on end cap 92'.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

We claim:

1. A device for rolling up and unrolling a floating mat having a first end, a second end, a first side, a second side, an upper surface and a bottom surface, comprising:

an elongated hollow cylinder having a first end, a second end, and an outer surface;

said cylinder having an elongated slot, having first and second ends, formed in said outer surface thereof which extends between said first and second ends of said cylinder;

an elongated mat retainer having a first end, a second end, a first side and a second side;

said mat retainer having an elongated slot formed therein which extends inwardly thereinto from said first side thereof;

said slot of said mat retainer being configured to receive the first end of the floating mat therein;

the first end of the floating mat being secured to said mat retainer;

said mat retainer and the first end of the floating mat being positioned in said cylinder by slidably extending said mat retainer and the first end of the floating mat into one of said first and second ends of said cylinder with the floating mat extending outwardly through said slot in said cylinder;

a first end cap selectively secured to said first end of said cylinder;

a second end cap selectively secured to said second end of said cylinder;

an elongated first lever, having first and second ends, extending outwardly from said first end cap with said first lever being transversely disposed with respect to said cylinder; and an elongated second lever, having first and second ends, extending outwardly from said second end cap with said second lever being transversely disposed with respect to said cylinder.

2. The device of claim 1 wherein each of said first and second levers are slidably secured to said first and second end caps respectively.

3. The device of claim 1 wherein each of said first and second levers has an enlarged cap nut threadably secured to one end thereof whereby said first and second levers may be removed from said first and second end caps upon the removal of said cap nuts from said levers.

4. A device for rolling up and unrolling a floating mat having a first end, a second end, a first side, a second side, an upper surface and a bottom surface, comprising:

an elongated hollow cylinder having a first end, a second end, and an outer surface;

said cylinder having an elongated slot, having first and second ends, formed in said outer surface thereof which extends between said first and second ends of said cylinder;

an elongated mat retainer having a first end, a second end, a first side and a second side;

the first end of the floating mat being secured to said mat retainer;

said mat retainer and the first end of the floating mat being positioned in said cylinder by slidably extending said mat retainer and the first end of the floating mat into one of said first and second ends of said cylinder with the floating mat extending outwardly through said slot in said cylinder;

a first end cap selectively secured to said first end of said cylinder;

a second end cap selectively secured to said second end of said cylinder;

an elongated first lever, having first and second ends, extending outwardly from said first end cap with said first lever being transversely disposed with respect to said cylinder; and an elongated second lever, having first and second ends, extending outwardly from said second end cap with said second lever being transversely disposed with respect to said cylinder.

5. The device of claim 4 wherein each of said first and second levers are slidably secured to said first and second end caps respectively.

6. The device of claim 4 wherein each of said first and second levers has an enlarged cap nut threadably secured to one end thereof whereby said first and second levers may be removed from said first and second end caps upon the removal of said cap nuts from said levers.

7. A device for rolling up and unrolling a floating mat having a first end, a second end, a first side, a second side, an upper surface and a bottom surface, comprising:

an elongated hollow cylinder having a first end, a second end, and an outer surface;

said cylinder having an elongated slot, having first and second ends, formed in said outer surface thereof which extends between said first and second ends of said cylinder;

an elongated mat retainer having a first end, a second end, a first side and a second side;

said mat retainer having an elongated slot formed therein which extends inwardly thereinto from said first side thereof;

said slot of said mat retainer being configured to receive the first end of the floating mat therein;

the first end of the floating mat being secured to said mat retainer;

said mat retainer and the first end of the floating mat being positioned in said cylinder by slidably extending said mat retainer and the first end of the floating mat into one of said first and second ends of said cylinder with the floating mat extending outwardly through said slot in said cylinder;

a first end cap selectively secured to said first end of said cylinder;

said first end cap having inner and outer ends;

said outer end of said first end cap having a first handle which is configured to be grasped by a person to carry the device;

a second end cap selectively secured to said second end of said cylinder;

said second end cap having inner and outer ends;

said outer end of said second end cap having a second handle which is configured to be grasped by a person to carry the device;

an elongated first lever, having first and second ends, extending outwardly from said first end cap with said first lever being transversely disposed with respect to said cylinder; and an elongated second lever, having first and second ends, extending outwardly from said second end cap with said second lever being transversely disposed with respect to said cylinder.

8. The device of claim 7 wherein each of said first and second levers are slidably secured to said first and second end caps respectively.

9. The device of claim 7 wherein each of said first and second levers has an enlarged cap nut threadably secured to one end thereof whereby said first and second levers may be removed from said first and second end caps upon the removal of said cap nuts from said levers.

10. A device for rolling up and unrolling a floating mat having a first end, a second end, a first side, a second side, an upper surface and a bottom surface, comprising:

an elongated hollow cylinder having a first end, a second end, and an outer surface;

said cylinder having an elongated slot, having first and second ends, formed in said outer surface thereof which extends between said first and second ends of said cylinder;

an elongated mat retainer having a first end, a second end, a first side and a second side;

said mat retainer having an elongated slot formed therein which extends inwardly thereinto from said first side thereof;

said slot of said mat retainer being configured to receive the first end of the floating mat therein;

the first end of the floating mat being secured to said mat retainer;

said mat retainer and the first end of the floating mat being positioned in said cylinder by slidably extending said mat retainer and the first end of the floating mat into one of said first and second ends of said cylinder with the floating mat extending outwardly through said slot in said cylinder;

a first end cap selectively secured to said first end of said cylinder;

a second end cap selectively secured to said second end of said cylinder;

said first and second end caps being threadably secured to said first and second ends of said cylinder respectively;

an elongated first lever, having first and second ends, extending outwardly from said first end cap with said first lever being transversely disposed with respect to said cylinder; and an elongated second lever, having first and second ends, extending outwardly from said second end cap with said second lever being transversely disposed with respect to said cylinder.

11. A device for rolling up and unrolling a floating mat having a first end, a second end, a first side, a second side, an upper surface and a bottom surface, comprising:

an elongated hollow cylinder having a first end, a second end, and an outer surface;

said cylinder having an elongated slot, having first and second ends, formed in said outer surface thereof which extends between said first and second ends of said cylinder;

an elongated mat retainer having a first end, a second end, a first side and a second side;

said mat retainer having an elongated slot formed therein which extends inwardly thereinto from said first side thereof;

said slot of said mat retainer being configured to receive the first end of the floating mat therein;

the first end of the floating mat being secured to said mat retainer;

said mat retainer and the first end of the floating mat being positioned in said cylinder by slidably extending said mat retainer and the first end of the floating mat into one of said first and second ends of said cylinder with the floating mat extending outwardly through said slot in said cylinder;

a first end cap selectively secured to said first end of said cylinder;

a second end cap selectively secured to said second end of said cylinder;

each of said first and second end caps being cylindrical with open ends;

an elongated first lever, having first and second ends, extending outwardly from said first end cap with said first lever being transversely disposed with respect to said cylinder; and an elongated second lever, having first and second ends, extending outwardly from said second end cap with said second lever being transversely disposed with respect to said cylinder.

12. A device for rolling up and unrolling a floating mat having a first end, a second end, a first side, a second side, an upper surface and a bottom surface, comprising:

an elongated hollow cylinder having a first end, a second end, and an outer surface;

said cylinder having an elongated slot, having first and second ends, formed in said outer surface thereof which extends between said first and second ends of said cylinder;

an elongated mat retainer having a first end, a second end, a first side and a second side;

the first end of the floating mat being secured to said mat retainer;

said mat retainer and the first end of the floating mat being positioned in said cylinder by slidably extending said mat retainer and the first end of the floating mat into one of said first and second ends of said cylinder with the floating mat extending outwardly through said slot in said cylinder;

a first end cap selectively secured to said first end of said cylinder;

a second end cap selectively secured to said second end of said cylinder;

said first and second end caps being threadably secured to said first and second ends of said cylinder respectively;

an elongated first lever, having first and second ends, extending outwardly from said first end cap with said first lever being transversely disposed with respect to said cylinder; and an elongated second lever, having first and second ends, extending outwardly from said second end cap with said second lever being transversely disposed with respect to said cylinder.

13. A device for rolling up and unrolling a floating mat having a first end, a second end, a first side, a second side, an upper surface and a bottom surface, comprising:

an elongated hollow cylinder having a first end, a second end, and an outer surface;

said cylinder having an elongated slot, having first and second ends, formed in said outer surface thereof which extends between said first and second ends of said cylinder;

an elongated mat retainer having a first end, a second end, a first side and a second side;

the first end of the floating mat being secured to said mat retainer;

said mat retainer and the first end of the floating mat being positioned in said cylinder by slidably extending said mat retainer and the first end of the floating mat into one of said first and second ends of said cylinder with the floating mat extending outwardly through said slot in said cylinder;

a first end cap selectively secured to said first end of said cylinder;

a second end cap selectively secured to said second end of said cylinder;

each of said first and second end caps being cylindrical with open ends;

an elongated first lever, having first and second ends, extending outwardly from said first end cap with said first lever being transversely disposed with respect to said cylinder; and an elongated second lever, having first and second ends, extending outwardly from said second end cap with said second lever being transversely disposed with respect to said cylinder.

14. A device for rolling up and unrolling a floating mat having a first end, a second end, a first side, a second side, an upper surface and a bottom surface, comprising:

an elongated hollow cylinder having a first end, a second end, and an outer surface;

said cylinder having an elongated slot, having first and second ends, formed in said outer surface thereof which extends between said first and second ends of said cylinder;

an elongated mat retainer having a first end, a second end, a first side and a second side;

said mat retainer having an elongated slot formed therein which extends inwardly thereinto from said first side thereof;

said slot of said mat retainer being configured to receive the first end of the floating mat therein;

the first end of the floating mat being secured to said mat retainer;

said mat retainer and the first end of the floating mat being positioned in said cylinder by slidably extending said mat retainer and the first end of the floating mat into one of said first and second ends of said cylinder with the floating mat extending outwardly through said slot in said cylinder;

a first end cap selectively secured to said first end of said cylinder;

said first end cap having inner and outer ends;

said outer end of said first end cap having a first handle which is configured to be grasped by a person to carry the device;

a second end cap selectively secured to said second end of said cylinder;

said second end cap having inner and outer ends;

said outer end of said second end cap having a second handle which is configured to be grasped by a person to carry the device;

each of said first and second end caps being threadably secured to said cylinder respectively;

an elongated first lever, having first and second ends, extending outwardly from said first end cap with said first lever being transversely disposed with respect to said cylinder; and an elongated second lever, having first and second ends, extending outwardly from said second end cap with said second lever being transversely disposed with respect to said cylinder.

* * * * *